US008813739B2

(12) United States Patent
Kwon et al.

(10) Patent No.: US 8,813,739 B2
(45) Date of Patent: Aug. 26, 2014

(54) BURNER ASSEMBLY AND COOKING APPLIANCE

(75) Inventors: Jung-Ju Kwon, Changwon-si (KR); In-Sik Min, Changwon-si (KR); Sang-Min Lyu, Changwon-si (KR); Seong-Sig Cho, Changwon-si (KR)

(73) Assignee: LG Electronics Inc., Seoul (KR)

( * ) Notice: Subject to any disclaimer, the term of this patent is extended or adjusted under 35 U.S.C. 154(b) by 791 days.

(21) Appl. No.: 12/328,475

(22) Filed: Dec. 4, 2008

(65) Prior Publication Data

US 2009/0173333 A1 Jul. 9, 2009

(30) Foreign Application Priority Data

Dec. 5, 2007 (KR) ..... 10-2007-0125836

(51) Int. Cl.
*F24C 3/08* (2006.01)
*F24C 3/06* (2006.01)

(52) U.S. Cl.
CPC ..... *F24C 3/067* (2013.01)
USPC ... 126/39 E; 126/39 J; 126/39 H; 126/214 R; 126/221; 431/351; 431/354; 99/330

(58) Field of Classification Search
USPC ..... 126/39 E, 39 J, 39 H, 39 R, 39 B, 214 R, 126/221; 431/331, 354, 226, 328, 329; 99/330, 403
See application file for complete search history.

(56) References Cited

U.S. PATENT DOCUMENTS

| | | | | | |
|---|---|---|---|---|---|
| 3,299,938 | A * | 1/1967 | Bally et al. | ..... | 431/210 |
| 4,067,681 | A * | 1/1978 | Reid et al. | ..... | 431/10 |
| 4,580,550 | A * | 4/1986 | Kristen et al. | ..... | 126/39 J |
| 4,639,213 | A * | 1/1987 | Simpson | ..... | 431/326 |
| 5,601,062 | A * | 2/1997 | Kim | ..... | 123/306 |
| 2006/0040228 | A1 * | 2/2006 | Kim et al. | ..... | 431/329 |

FOREIGN PATENT DOCUMENTS

JP 2002-39546 A 2/2002

OTHER PUBLICATIONS

English language abstract of KR-100776446-B1 (Nov. 7, 2007).

* cited by examiner

*Primary Examiner* — Avinash Savani
(74) *Attorney, Agent, or Firm* — Birch, Stewart, Kolasch & Birch, LLP

(57) ABSTRACT

A burner assembly is provided. The burner assembly includes a burner pot, a combustion mat, a pot cover, and a burner frame. The burner pot receives gas and air. A mixed gas of the gas and air supplied into the burner pot is burned in the combustion. The pot cover is disposed between the burner pot and the combustion mat to support the combustion mat. The burner frame guides combustion gas generated due to the combustion of the mixed gas in the combustion mat.

12 Claims, 14 Drawing Sheets

BURNER ASSEMBLY AND COOKING APPLIANCE

CROSS-REFERENCE TO RELATED APPLICATIONS

The present application claims priority under 35 U.S.C. 119 and 35 U.S.C. 365 to Korean Patent Application No. 10-2007-0125836 (filed on Dec. 5, 2007), which is hereby incorporated by reference in its entirety.

BACKGROUND

Embodiments relate to a burner assembly and a cooking appliance.

A cooking appliance is a home appliance that uses gas, electricity, etc. to heat foods. In general, a plurality of burners is provided on a top surface of the cooking appliance that uses the gas, and flames generated when the gas is burned at the burners heat vessels in which the foods are contained to directly heat the foods. The flames generated by the cooking appliance are exposed to the outside.

SUMMARY

Embodiments provide a burner assembly configured so that it can be safely used, and a cooking appliance including the burner assembly.

Embodiments also provide a burner assembly and a cooking appliance with improved operational reliability.

Embodiments further provide a burner assembly and a cooking appliance with a simplified structure.

In one embodiment, a burner assembly includes; a burner pot receiving gas and air; a combustion mat in which a mixed gas of the gas and the air supplied into the burner pot is burned; a pot cover between the burner pot and the combustion mat to support the combustion mat; and a burner frame configured to guide combustion gas generated due to the combustion of the mixed gas in the combustion mat.

In another embodiment, a cooking appliance includes: a burner pot receiving mixed gas of gas and air; a tube assembly configured to guide the gas and the air into the burner pot; a combustion mat in which the mixed gas supplied into the burner pot is burned; a guide member configured to guide the mixed gas of the burner pot into the combustion mat; and a burner frame configured to guide a flow of combustion gas generated due to the combustion of the mixed gas in the combustion mat.

In a further embodiment, a cooking appliance includes: a cabinet; a burner assembly inside the cabinet, the burner assembly burning a mixed gas and exhausting the burned combustion gas; a nozzle assembly spaced from the burner assembly, the nozzle assembly supplying the mixed gas into the burner assembly; a barrier preventing heat of the combustion gas from being moved toward at least nozzle assembly; and a top plate above the burner assembly.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present invention, examples of which are illustrated in the accompanying drawings.

Figure 1:
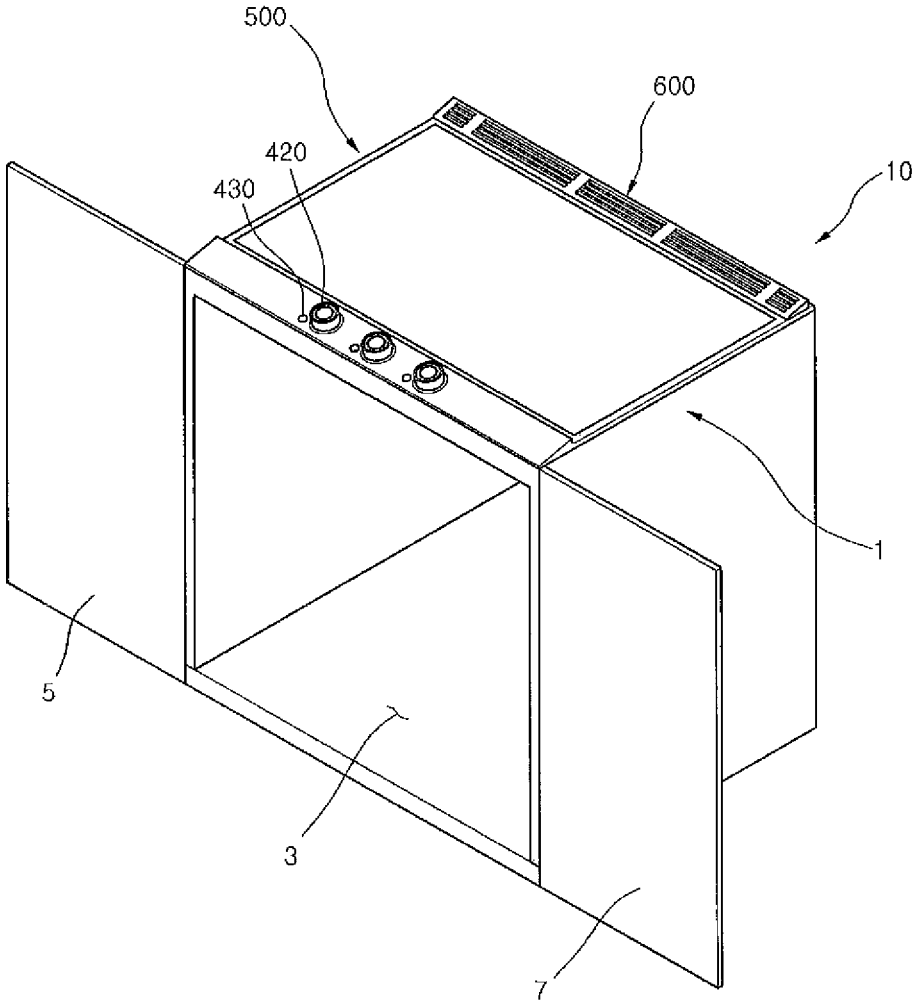
FIG. 1 is a perspective view of a cooking appliance in use according to an embodiment.
Figure 2:
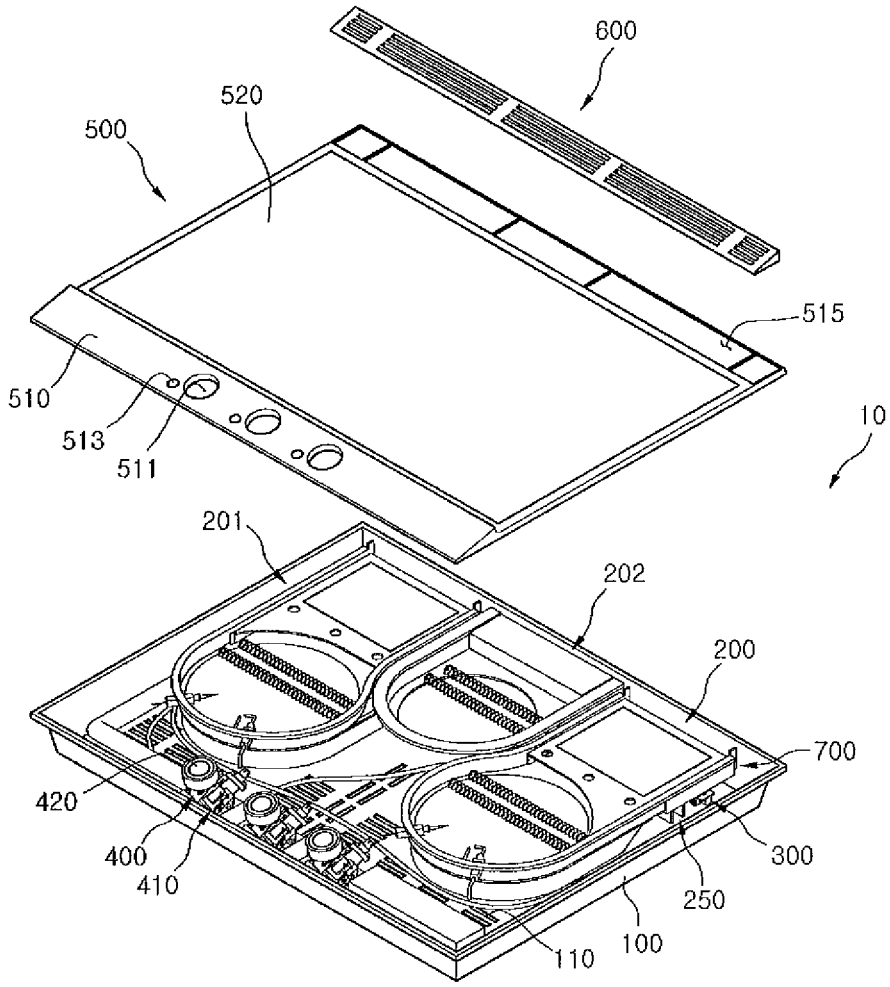
FIG. 2 is an exploded perspective view of a cooking appliance according to an embodiment.

FIG. 1 is a perspective view of a cooking appliance in use according to an embodiment, and FIG. 2 is an exploded perspective view of a cooking appliance according to an embodiment.

Referring to FIGS. 1 and 2, a built-in type cooking appliance will be exemplarily described in this embodiment.

A cooking appliance 10 according to this embodiment is installed in furniture 1. An installation space 3 is defined within the furniture 1, and a front surface and a top surface of the furniture 1 are opened. The cooking appliance 10 is installed in the opened top surface of the furniture 1.

A pair of doors 5 and 7 is disposed on the furniture 1 to open and close the open front surface of the furniture 1.

The cooking appliance 10 includes a cabinet 100 and a top cover 500 that define its external shape. The cabinet 100 has a hexahedral shape with an opened top surface. The top cover 500 covers the opened top surface of the cooking appliance 10.

A plurality of cooling holes 110 is defined in a floor of the cabinet 100. Air for cooling components provided within the cabinet 100 can enter into or exit to the outside of the cabinet 100 through the cooling holes 110. Also, a cooling passage P3 (See FIG. 14) is provided inside the cabinet 100 to circulate the air passing through the cooling holes 110.

Hereinafter, an inner structure of the cooking appliance will be described in detail.

Referring to FIG. 2, provided within the cabinet 100 are a plurality of burner assemblies 200, 201, and 202 for mixing gas with air and combusting the mixed gas, a plurality of nozzle assemblies 300 for discharging the gas, and a controller 400 for controlling an operation of the plurality of burner assemblies 200, 201, and 202.

The plurality of burner assemblies 200, 201, and 202 combusts the mixed gas while simultaneously guiding a flow of air for forming the mixed gas, and guiding a flow of combustion gas generated from the combustion of the mixed gas.

The plurality of nozzle assemblies 300 supplies the gas to the burner assemblies 200, 201, and 202. The controller 400 controls the operation of the burner assemblies 200, 201, and 202 and the nozzle assemblies 300.

The plurality of burner assemblies 200, 201, and 202 includes three burner assemblies, that is, first to third burner assemblies 200, 201, and 202.

The first and second burner assemblies 200 and 201 are installed within the cabinet 100 at right and left portions (in FIG. 2), respectively. The third burner assembly 202 is installed between the first and second burners 200 and 201, that is, at a central portion within the cabinet 100. The first to third burner assemblies 200, 201, and 202 may be different in size.

Although three burner assemblies are installed within the cabinet 100 in this embodiment, there is no restriction on the number of burner assemblies. For example, at least one or more burner assembly may be provided within the cabinet 100.

The first to third burner assemblies 200, 201, and 202 are fixed inside the cabinet 100 in a state where each of rear ends of the first to third burner assemblies 200, 201, and 202 is connected to a connection bracket 700. The connection bracket 700 includes a fixing part 710 (See FIG. 11) having a horizontal rectangle shape and a guide part 720 (See FIG. 11) vertically extending from a rear end of the fixing part 710.

The first to third burner assemblies 200, 201, and 202 are fixed by the fixing part 710. The flow guide part 720 partitions air and combustion gas suctioned and exhausted through a flow guide unit 600 that will be described later, and simultaneously, guides a flow of the air and the combustion gas. An exhaust guide part 730 (See FIG. 11) is provided in a front end of the flow guide part 720. The exhaust guide part 730 extends upwardly inclinedly in a front direction.

The exhaust guide part 730 prevents the air exhausted into the outside through an exhaust hole 620 (See FIG. 11) that will be described later from moving toward a suction hole 610.

The plurality of nozzle assemblies 300 includes three nozzle assemblies 300. The nozzle assemblies 300 supplies gas supplied from an external gas supply source to the first to third burner assemblies 200, 201, and 202.

The controller 400 is installed in a front direction of the first to third burner assemblies 200, 201, and 202, that is, an inner front end of the cabinet 100. The controller 400 includes three valve assemblies 410 for determining whether the gas is supplied and adjusting a gas supply amount. A knob is coupled to each of the valve assemblies 410. The knob is a grasping portion for allowing a user to manipulate the valve assemblies 410.

A light emitter 430 is provided in each of the valve assemblies 410. The light emitter 430 turns on/off in cooperation with an operation of the valve assemblies 410 to display whether the first to third burner assemblies 200, 201, and 202 are ignited.

The top cover 500 includes a top frame 510 and a top plate 520.

A plurality of knob through holes 511 through which the knob of each of the valve assemblies 410 passes is disposed in a front end of the top frame 510. Also, a plurality of light emitter through holes 513 through which the light emitter 430 passes is disposed in the front end of the top frame 510.

A plurality of openings 515 for suctioning and exhausting the air is defined in a rear end of the top frame 510. Each of the openings serves as a passage through which an outside air to be supplied into each of the burner assemblies 200, 201, and 202 is suctioned and the combustion gas generated due to the combustion of the mixed gas is exhausted.

That is, the outside air and the inner combustion gas are respectively suctioned and exhausted through a single opening 515 in this embodiment. As described above, a suction passage P1 (See FIG. 11) through which the outside air is suctioned from the outside and an exhaust passage P2 (See FIG. 11) of the combustion gas are partitioned by the flow guide part 720 inside the cabinet 100.

The top plate 520 is disposed on the top frame 510. The top plate 520 transmits heat generated from the combustion of the mixed gas to foods.

For example, the top plate 520 may include a glass formed of a ceramic material. A vessel containing the foods is seated on the top surface of the top plate 520. A vessel seat part (not shown) for displaying a position on which the vessel is seated may be disposed on the top plate 520.

The flow guide unit 600 is provided in a rear side of the top surface of the top plate 510. The flow guide unit 600 guides the suction of the outside air to be supplied into each of the burner assemblies 200, 201, and 202 and the exhaust of the combustion gas of each of the burner assemblies 200, 201, and 202.

Hereinafter, a structure of a burner assembly will be described in detail.

Figure 3:
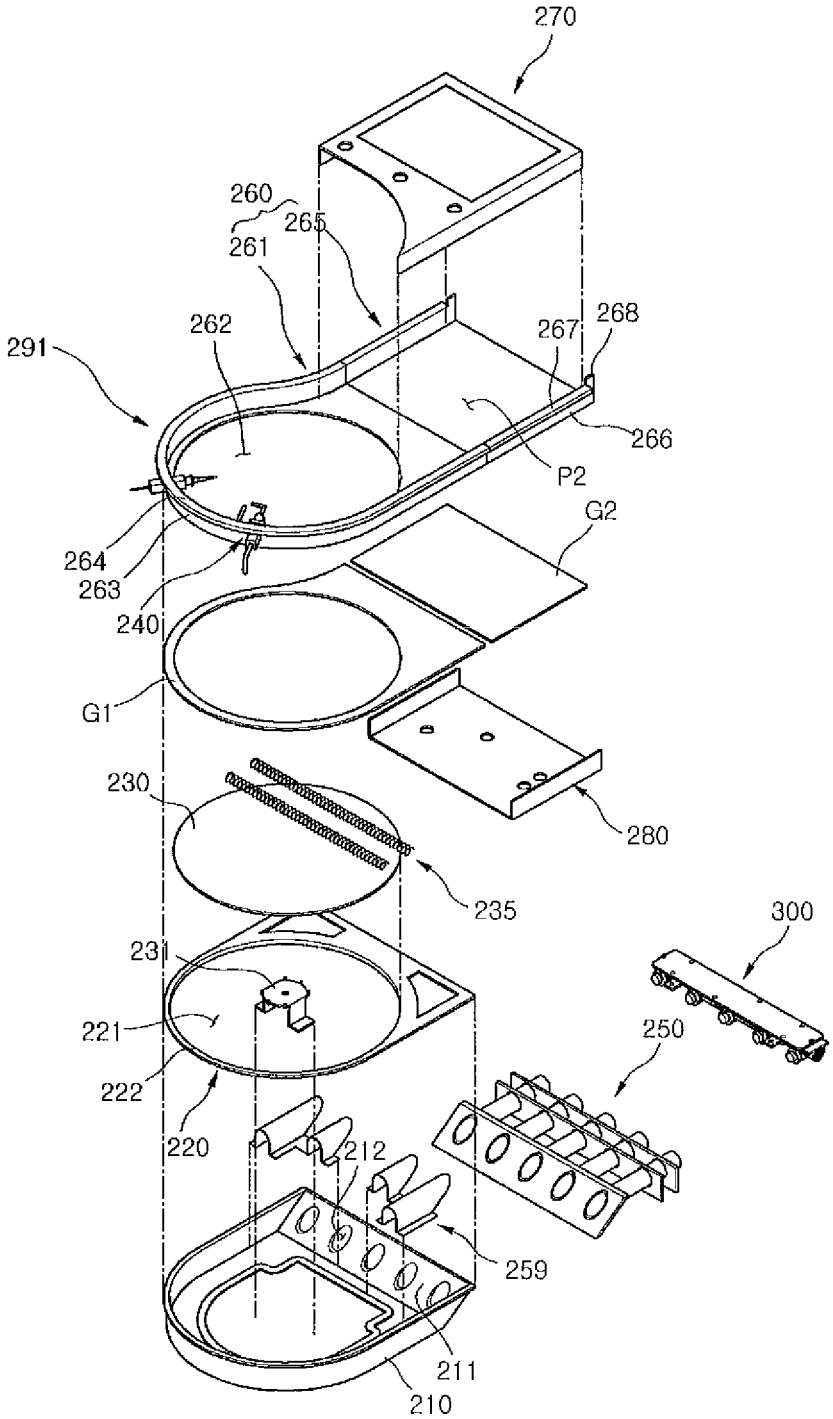
FIG. 3 is an exploded perspective view of a burner assembly according to an embodiment.
Figure 4:
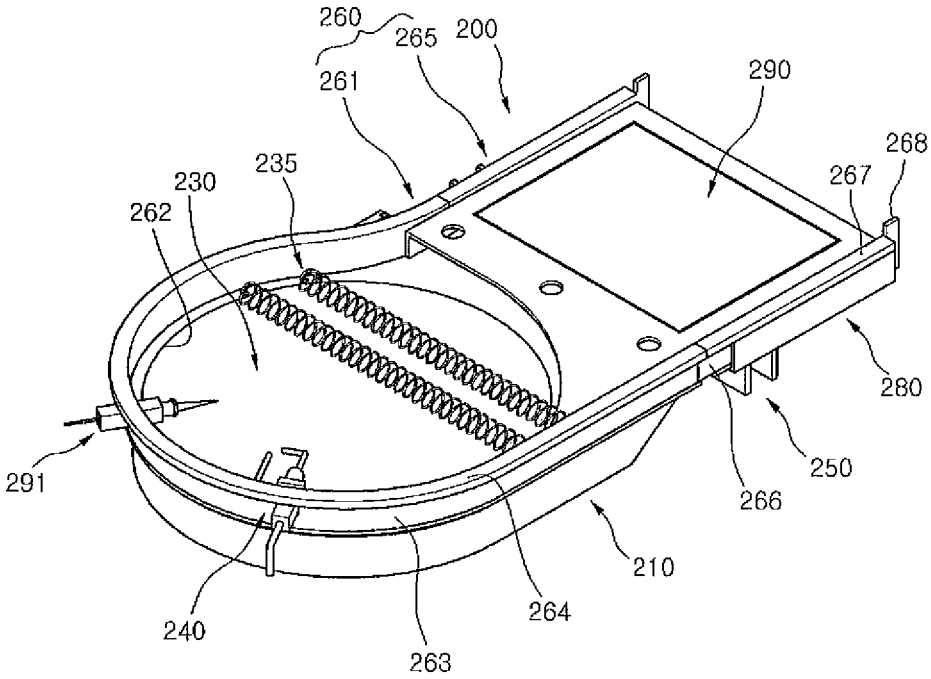
FIG. 4 is a perspective view illustrating a top surface of a burner assembly according to an embodiment.
Figure 5:
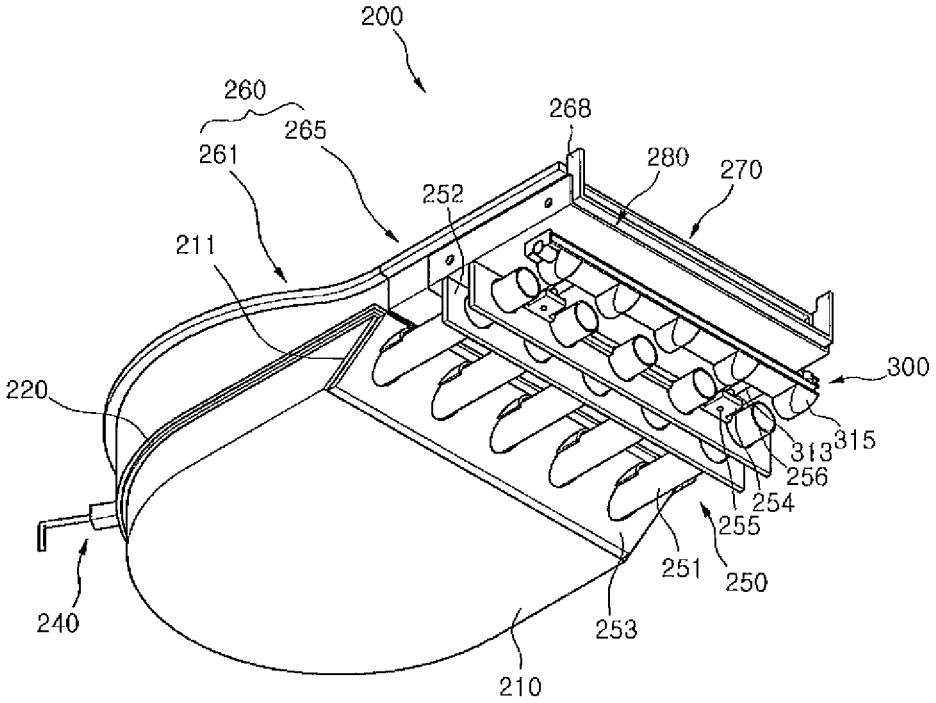
FIG. 5 is a perspective view illustrating a bottom surface of a burner assembly according to an embodiment.

FIG. 3 is an exploded perspective view of a burner assembly according to an embodiment, FIG. 4 is a perspective view illustrating a top surface of a burner assembly according to an embodiment, and FIG. 5 is a perspective view illustrating a bottom surface of a burner assembly according to an embodiment.

Referring to FIGS. 3 to 5, since first to third burner assemblies according to this embodiment have the same composition except for size, only the first burner assembly 200 (hereinafter, for convenience in description, refer to as a "burner assembly") of the first to third burner assemblies 200, 201, and 202 will be described.

The burner assembly 200 includes a combustion part, an ignition part, a mixing part, and an exhaust part.

Mixed gas is burned in the combustion part, and the combustion part includes a burner pot 210, a pot cover 220, and a combustion mat 230.

The ignition part generates a spark for the combustion of the mixed gas in the combustion part. The ignition part includes a plug assembly 240.

The mixing part mixes gas with air to supply the mixed gas to the combustion part. The mixing part includes a tube assembly 250 and a guide tube 259.

The exhaust part guides the exhaust of the combustion gas generated due to the combustion of the mixed gas in the combustion part. The exhaust part includes a burner frame 260, an upper barrier 270, and a lower barrier 280.

In detail, the burner pot 210 has an opened top surface. The mixed gas is supplied inside the burner pot 210.

An inclined surface 211 is provided in a rear side of the burner pot 210. The inclined surface 211 extends downwardly inclinedly from an upper portion of the burner pot 210.

A plurality of mixed gas supply holes 212 is defined in the inclined surface 211. For example, five mixed gas supply holes 212 are illustrated in FIG. 3.

The pot cover 220 shields the opened top surface of the burner pot 210. A mixed gas guide hole 221 is defined in the pot cover 220 to guide the mixed gas supplied inside the burner pot 210 to the combustion mat 230. Thus, a portion except for the mixed gas guide hole 221 of the pot cover 220 shields the top surface of the burner pot 210 to guide the mixed gas to the combustion mat, thereby to refer to a guide member.

A mat seat part is disposed on the pot cover 220. A portion of the pot cover 220 is stepped downwardly to form the mat seat part of the pot cover 220.

The mixed gas is substantially burned in the combustion mat 230. The combustion mat 230 is seated on the mat seat part 222. The combustion mat may have the same top surface as that of the pot cover 220. The combustion mat 230 may be formed of a ceramic material.

A combustion interfering member 231 is provided inside the burner pot 210. The combustion interfering member 231 interferes (or decreases) with the combustion of the mixed gas at a central portion of the combustion mat 230.

That is, the combustion interfering member 231 concentrates heat in a space between the top plate 520 and a bottom surface of the vessel to prevent the top plate 520 and/or the vessel from being damaged in case where foods are contained within the vessel such as an earthen bowl in which a central portion of the bottom surface is depressed upwardly.

The combustion interfering member 231 is seated on the burner pot 210. The combustion interfering member 231 is disposed closely on the central portion of a bottom surface of the combustion mat 230 to prevent the mixed gas from being burned at the central portion of the combustion mat 230 or adjacent to the central portion of the bottom surface of the combustion mat 230 to reduce the combustion of the mixed gas.

The tube assembly 250 includes a plurality of mixing tubes 251, a plurality of air barriers 252, and a contact part 253.

The gas and the air are substantially mixed in the mixing tube 251, and simultaneously, the mixing tube 251 guides the mixed gas into the burner pot 210. Each of the mixing tube 251 has a cylinder shape having a diameter corresponding to that of the mixed gas supply hole 212 when viewed in plan. A front end of each of the mixing tube 251 has an inclined surface corresponding to the inclined surface 211.

The plurality of air barriers 252 is horizontally provided along left and right sides of a rear end of the mixing tube 251. The plurality of air barriers 252 is spaced from each other in front and rear directions.

The air barriers 252 prevent the air suctioned inside the cabinet 100 through the cooling holes 110 from flowing toward the nozzle assembly 300.

In detail, referring to FIG. 1, when the doors 5 and 7 of the furniture 1 are opened and closed, a large amount of air may be introduced into the installation space 3. Then, the air introduced into the installation space 3 is introduced inside the cabinet 100 through the cooling holes 110. In case where the air introduced inside the cabinet 100 flows toward the nozzle assembly 300, it prevents air around the nozzle assembly 300 and air injected from the nozzle assembly 300 from flowing into each of the mixing tubes 251.

However, according to this embodiment, it can prevent air introduced inside the cabinet 100 through the cooling holes 110 by the air barriers 252 from flowing toward the nozzle assembly 300.

Also, each of the air barriers 252 is coupled to the plurality of mixing tubes 251. The contact part 253 is connected to the front end of each of the mixing tubes 251.

Since the contact part 253 has the same inclined surface as the inclined surface 211, the contact part 253 may be closely attached to the inclined surface 211. Thus, it can prevent the mixed gas from each of mixing tubes 251 to the burner pot 210 from leaking into the outside.

The contact part 253 is coupled to a coupling member (not shown) in a state where the contact part 253 is closely attached to the inclined surface 211.

The tube assembly 250 includes a plurality of coupling ribs 244 to couple the tube assembly to the nozzle assembly 300. The plurality of coupling ribs 244 is disposed on the air barriers 252. A coupling hole 255 is defined in each of the coupling ribs 254. A guide protrusion 256 to be coupled to the nozzle assembly 300 is disposed on a top surface of the each of coupling ribs 254.

Although not shown, a gasket may be provided on a portion at which the burner pot 210 is closely attached to the tube assembly 250, that is, between the inclined surface 211 and the contact part 253.

The gasket prevents the mixed gas to be supplied from the tube assembly 250 to the burner assembly 200 from leaking through a gap.

The guide tube 259 is disposed inside the burner pot 210. A length of the mixing tube 251 extends by the guide tube 259 to increase mixing efficiency of the gas and the air.

That is, a flow distance in which the gas is substantially mixed with the air increases due to the guide tube 259 to increase the mixing efficiency of the gas and the air.

A rear end of the guide tube 259 is inclined at an angle corresponding to that of the inclined surface 211. The guide does not vertically overlap with the combustion mat 230 such that the guide tube 259 does not prevent the combustion within the combustion mat 230.

The burner frame 260 is disposed above the combustion mat 230.

The burner frame 260 includes a first burner frame 261 and a second burner frame 265. The first burner frame 261 guides the combustion gas generated due to the combustion of the mixed gas in the combustion mat 230 into the second burner frame 265. The first burner frame 261 is fixed to the pot cover 220. Thus, the combustion mat 230 may be fixed in position due to the first burner frame 261 and the pot cover 220. The second burner frame 265 guides the combustion gas into the flow guide unit 600.

A heat transmission hole 262 is fined in a central portion of the first burner frame 261 to easily transmit heat generated due to the combustion of the mixed gas in the combustion mat 230 to the top plate 520. The heat transmission hole 262 may have a circular shape corresponding to that of the mixed gas guide hole 262.

The first burner frame 261 includes a guide rib 263 and a plate support rib 264. The guide rib 263 guides the combustion gas generated due to the combustion of the mixed gas in the combustion mat 230 to flow into the second burner frame 265 without dispersing the combustion gas.

Also, the guide rib 263 guides heat generated due to the combustion of the mixed gas in the combustion mat 230 to concentrate the heat to the top plate 520 without dispersing the heat.

The guide rib 263 extends upwardly from an edge of a bottom surface of the first burner frame 261 except for a rear end of the first burner frame 261.

The plate support rib 264 supports a bottom surface of the top plate 520. The plate support rib 264 extends from the guide rib 263 toward the outside of the first burner frame 261.

The second burner frame 265 is connected to the first burner frame 261. The second burner frame 265 may be integrated with the first burner frame 261 in one body or separated from the first burner frame 261 to couple the second burner frame 265 to the first burner frame 261.

The second burner frame 265 includes a guide rib 266 and a plate support rib 266. The guide rib 266 extends upwardly from both ends of the second burner frame 265 by a height equal to that of the guide rib 263 of the first burner frame 261.

The plate support rib 267 extends from an upper end of the guide rib 266 in both side directions. The plate support rib 267 supports the top plate 520.

A partition rib 268 is provided in a rear end of the guide rib 266. The partition rib 268 extends upwardly from the guide rib 266.

The partition rib 268 prevents the combustion gas generated from each of the burner assemblies 200, 201, and 202 from being mixed within the cabinet.

A plurality of hot wires 235 is provided above the combustion mat 230. The hot wires 235 allow a user to recognize whether the combustion gas is burned in the burner assembly 200 from the outside.

When a temperature of each of the hot wires 235 increases due to the combustion of the mixed gas in the combustion mat 130 to fade a color of each of the hot wires 235, the user can recognize that the combustion gas is being burned in the burner assembly 200.

Both ends of the hot wire 235 are fixed to the first burner frame 261. The hot wire 235 is fixed to the first burner frame 261 in a state where the hot wire 235 extends. This is done for a reason that it prevents the hot wire 235 from contacting with the combustion mat 230 by increasing a length of the hot wire 235 due to the heat.

A suction passage P1 (See FIG. 11) is provided under the burner frame 260 inside the cabinet 110. The air to be supplied into the burner assembly flows into the suction passage P1.

In this embodiment, the suction passage P1 is substantially defined by a floor of the cabinet 100 and a bottom surface of the second burner frame 265.

The upper barrier 270 is seated on the second burner frame 265 and positioned between the top plate 520 and the second burner frame 265. The upper barrier 270 has a ⊏ shape.

In this embodiment, an exhaust passage P2 through which the combustion gas flows is defined by the second burner frame 265 and the upper barrier 270. However, in case where the upper barrier 270 is removed, the exhaust passage P2 may be defined by the second burner frame 265 and the top plate 520.

The upper barrier 270 transmits a portion of heat of the combustion gas flowing through the exhaust passage P2, more specifically, heat actually usable for heating the foods to the top plate 520.

Thus, a warm zone in which the foods are heated by the combustion gas flowing through the exhaust passage P2 is defined in the top plate 520 disposed above the exhaust passage P2.

The lower batter 280 is coupled to a lower side of the second burner frame 265. One portion of the lower barrier 280 is disposed between the second burner frame 265 and the tube assembly 250, and the other portion of the lower barrier 280 is disposed between the second burner frame 265 and the nozzle assembly 300.

The lower barrier 280 prevents the heat of the combustion gas flowing through the exhaust passage P2 from being transmitted into the tube assembly 250 and the nozzle assembly 300. The lower barrier 280 has a ⊏ shape, and both side surfaces thereof are closely attached to the guide rib 266 of the second burner frame 265.

Gaskets G1 and G2 are disposed between the pot cover 220 and the first burner frame 261 and between the second burner frame 265 and the lower barrier 280, respectively.

The gasket G1 prevents the gas from leaking through a gap between the pot cover 220 and the first burner frame 261.

The gasket G2 prevents the heat from being heat-exchanged between the second burner frame 265 and the lower barrier 280.

In a state where the burner pot 210, the pot cover 220, the combustion mat 230, the gasket G1, and the burner frame 260 are vertically stacked, the burner pot 210 and the burner frame 260 are fixed to each other by a coupling member (not shown) to assemble the burner assembly 200.

At this time, the upper barrier 270 is seated on a top surface of the burner frame 260, and the lower barrier 280 is fixed to a bottom surface of the burner frame 260 by a coupling member (not shown).

Figure 6:
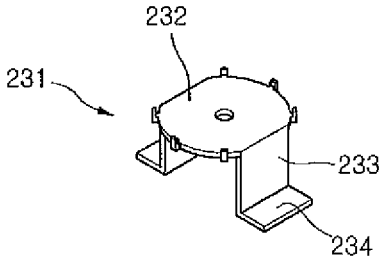
FIG. 6 is a perspective view of a combustion interfering member constituting a burner assembly according to an embodiment.

FIG. 6 is a perspective view of a combustion interfering member constituting a burner assembly according to an embodiment.

Referring to FIGS. 3 and 6, the combustion interfering member 231 includes an interferer 232, a plurality of supports 233, and a plurality of fixers 234.

The interferer 232 has a circular plate shape. The interferer 232 is closely attached to a central portion of a bottom surface of the combustion mat 230 or spaced a predetermined distance from the central portion of the bottom surface of the combustion mat 230.

The plurality of supports 233 extends downwardly from the interferer 232 to allow the interferer 232 to be supported at a predetermined height from a bottom surface of the burner pot 210. That is, the interferer 232 is spaced from the bottom surface of the burner pot 210. Thus, a flow of the mixed gas supplied into the burner pot 210 does not interfere by the combustion interfering member 231.

Each of the fixers 234 extends in a direction away from a lower end of each of the supports 233. Each of the fixers 234 is fixed to the bottom surface of the burner pot 210 using separate coupling units or a welding process.

Figure 7:
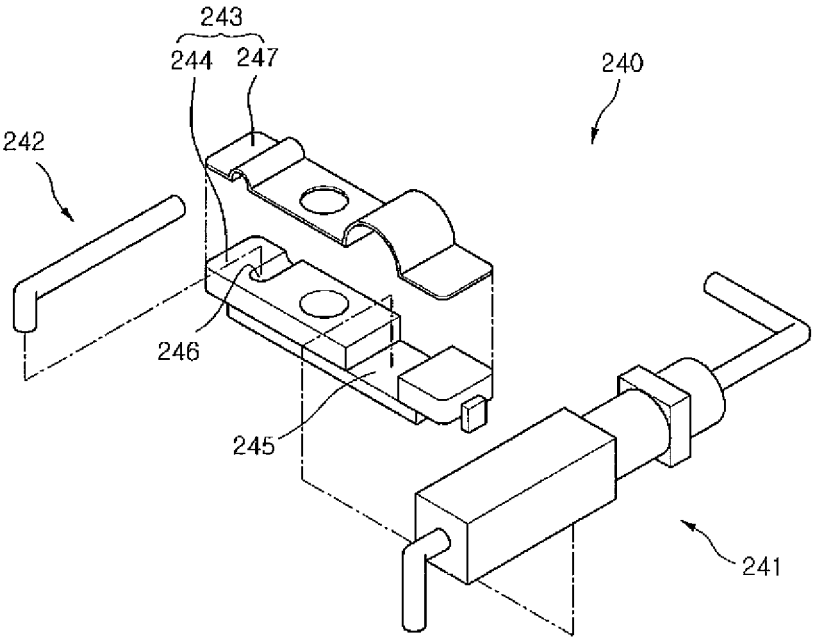
FIG. 7 is an exploded perspective view of a plug assembly constituting a burner assembly according to an embodiment.

FIG. 7 is an exploded perspective view of a plug assembly constituting a burner assembly according to an embodiment.

Referring to FIGS. 3 and 7, the plug assembly 240 includes an ignition plug 241, a plug target 242, and a plug holder 243. The ignition plug 241 and the plug target 242 generate a spark for igniting the mixed gas.

The plug target 242 is formed of a metal material, and spaced a predetermined distance from the ignition plug 241. When a power is applied to the ignition plug 241, the spark is generated between the ignition plug 241 and the plug target 242.

The ignition plug 241 and the plug target 242 are installed in the plug holder 243. The plug holder 243 is fixed to the first burner frame 261. The ignition plug 241 and the plug target 242 pass through the first burner frame 261 and are disposed above the combustion mat 230 in a state where the ignition plug 241 and the plug target 242 are installed in the plug holder 243.

The plug holder 243 includes a holder body 244 and a holder cover 247. The plug holder 243 includes a seat part 245 on which a side of the ignition plug 241 is seated and a target insertion hole 246 in which one end of the plug target 242 is inserted.

The holder cover 247 is coupled to an upper portion of the holder body 244 in a state where the ignition plug 241 is seated on the plug seat part 245, and the plug target 242 is inserted into the target insertion hole 246.

The plug holder 243 is coupled to the first burner frame 261 by the coupling member. In this embodiment, the plug holder 243 is formed of a metal material. Thus, since the plug holder 243 in which the plug target 242 is inserted is fixed to the first burner frame 261, it is possible to ground the plug assembly 240 without using an additional ground wire.

Figure 8:
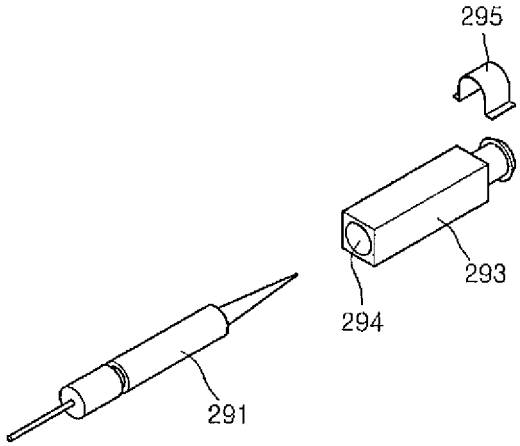
FIG. 8 is a perspective view of a thermocouple and a protective member constituting a burner assembly according to an embodiment.

FIG. 8 is a perspective view of a thermocouple and a protective member constituting a burner assembly according to an embodiment.

Referring to FIGS. 3 and 8, a thermocouple 291 is installed in the first burner frame 261.

The thermocouple 291 passes through the first burner frame 261. The thermocouple 291 has one portion disposed inside the first burner frame 261 and the other portion disposed outside the first burner frame 261.

When the mixed gas is burned in the combustion mat 230, the thermocouple 291 generates a predetermined electromotive force by a temperature difference between the portion disposed inside the first burner frame 261 and the portion disposed outside the first burner frame 261.

According to existence and nonexistence of the electromotive force of the thermocouple 291, the valve assemblies 410 maintain in an open state or the opened valve assemblies 410 are shielded.

The thermocouple 291 is surrounded by a protection member 293. The protection member 293 protects a portion of the thermocouple 291 disposed inside the first burner frame 261. That is, the protection member 293 prevents the thermocouple 291 from being damaged by the heat generated due to the combustion of the combustion gas in the combustion mat 230. In this embodiment, an insulator formed of a ceramic material for electrically insulating the thermocouple 291 may be used as the protection member 293.

The protection member 293 has a hexahedral shape. The protection member 293 includes a through hole 294 through which the thermocouple 291 passes. The protection member 293 has a side having a substantially cylinder shape. A bracket fixed to the first burner frame 261 is seated in the one end of the protection member 293 having the cylinder shape.

Figure 9:
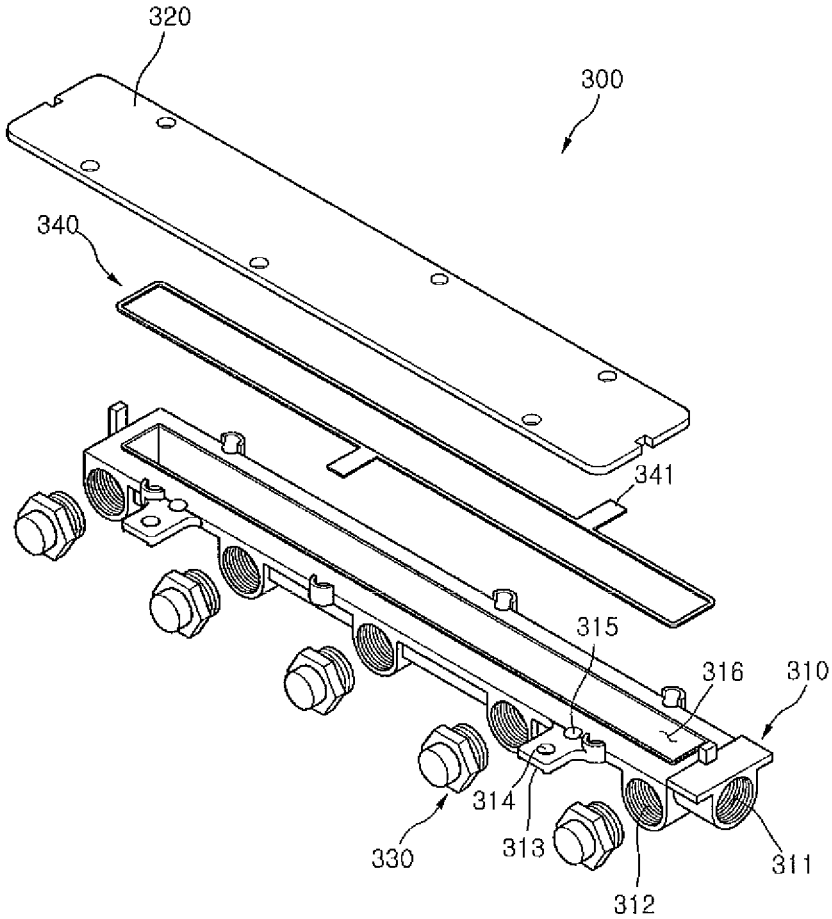
FIG. 9 is an exploded perspective view of a nozzle assembly according to an embodiment.

FIG. 9 is an exploded perspective view of a nozzle assembly according to an embodiment.

Referring to FIG. 9, the nozzle assemblies 300 according to this embodiment supply gas into each of the burner assemblies 200, 201, and 202. Although three nozzle assemblies 300 are provided in this embodiment, the nozzle assemblies 300 have the same composition as each other. Thus, one nozzle assembly 300 will now be described.

The nozzle assembly 300 includes a nozzle body 310, a nozzle cover 320, a plurality of injection nozzles, and a nozzle gasket 340.

The nozzle body 310 defines an external appearance of the nozzle assembly 300. The nozzle body 310 has an opened top surface. The nozzle body 310 includes a supply hole 311 and a plurality of injection holes 312. The supply hole 311 is connected to one end of a gas hose (not shown) for connecting the nozzle body 310 to each of the valve assemblies 410. The plurality of injection holes 312 is coupled to the plurality of injection nozzles 330. The supply hole 311 is defined in a side surface of the nozzle body 310. The plurality of injection holes 312 is defined in a front surface of the nozzle body 310 facing a rear end of the tube assembly 250.

Screw threads are disposed on inner circumference surfaces of the supply hole 311 and the plurality of injection holes 312 to couple them to the gas hose and the injection nozzles 330.

In order to minimize an amount of a material and the number of production processes for fabricating the nozzle body 310, the nozzle body 310 is formed of aluminum through a die-casting process, and the supply hole 311 and the injection holes 312 are fabricated using a tap process.

The nozzle cover 320 shields the opened top surface of the nozzle body 310. Thus, a predetermined space is defined between the nozzle body 310 and the nozzle cover 320. That is, a gas receiving space is defined between the nozzle body 310 and the nozzle cover 320. The space 316 communicates with the supply hole 311 and the injection holes 312.

Each of the injection nozzles 330 injects a high-pressure gas within the space 316 toward the mixing tube 251. Each of the injection nozzles 330 is coupled to each of the injection holes 312. In order that air surrounding the mixing tube 251 is introduced together into the mixing tube 251 while the gas injected from each of the injection nozzles 330 flows into the mixing tube 251, the injection nozzle 330 is spaced from a rear end of the mixing tube 251 in a state where the injection nozzle 330 is coupled to the injection hole 312.

A screw thread corresponding to that of the injection hole 312 is disposed on an outer circumference surface of the injection nozzle 330.

A plurality of coupling ribs 313 is disposed in the nozzle body 310. Each of the coupling ribs 313 extends forwardly from a front surface of the nozzle body 310, that is, toward the tube assembly 250. The coupling rib 313 includes a through hole 314 through which a coupling member (not shown) passes and a guide hole 315 in which the guide protrusion 256 of the tube assembly 250 is inserted.

Thus, the coupling member passing through the through hole 314 is coupled to the coupling hole 255 in a state where the guide protrusion 256 is inserted into the guide hole 313 to couple the tube assembly 250 to the nozzle assembly 300. The nozzle gasket 340 is disposed between the nozzle body 310 and the nozzle cover 320. The nozzle gasket 340 shields a gap between the nozzle body 310 and the nozzle cover 320. That is, the nozzle gasket 340 prevents the gas from leaking through the gap between the nozzle body 310 and the nozzle cover 320.

A distinguishable rib 341 is disposed on the nozzle gasket 340. The user may easily identify whether the nozzle gasket 340 is installed through the distinguishable rib 341. In the state where the nozzle gasket 340 is disposed between the nozzle body 310 and the nozzle cover 320, the distinguishable rib 341 is exposed outside the nozzle assembly 300. In a case where the distinguishable rib 341 is exposed outside the nozzle assembly 300, the user can identify that the nozzle gasket 340 has been installed in the nozzle assembly.

Figure 10:
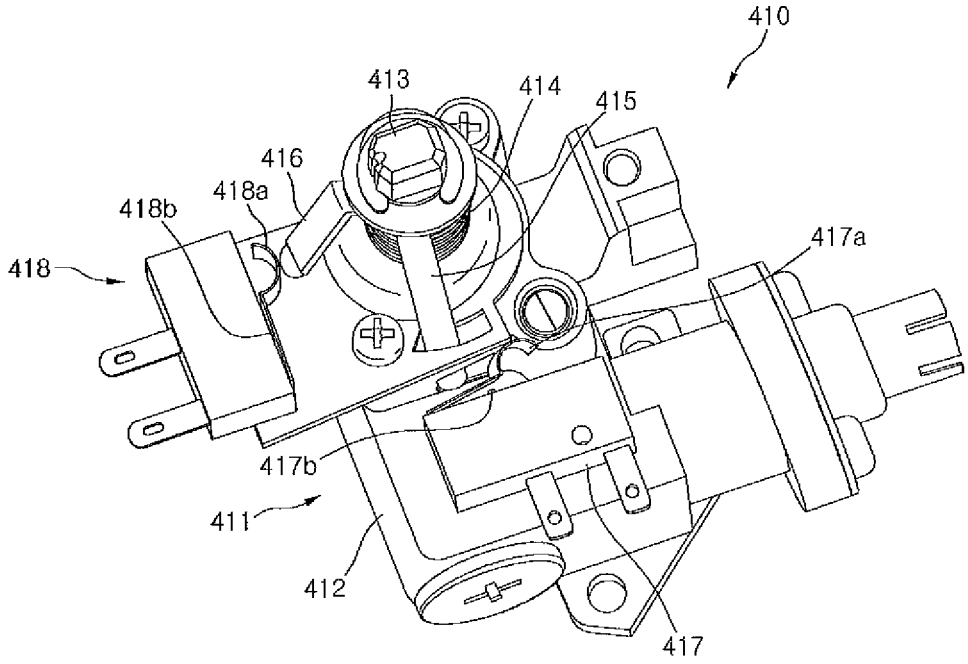
FIG. 10 is a perspective view of a valve assembly according to an embodiment.

FIG. 10 is a perspective view of a valve assembly according to an embodiment.

Referring to FIG. 10, the valve assembly 410 selectively supplies the gas into the nozzle assembly 300, and simultaneously, selectively turns on/off the light emitter 430.

The valve assembly 410 includes a valve 411, a first drive lever 415 and a second drive lever 416, an on-off switch 417, and an ignition switch 418.

The valve 411 determines whether the gas is supplied into the nozzle assembly 300 and adjusts a gas amount supplied into the nozzle assembly 300. The valve 411 includes a valve body 412, a valve shaft 413, and an elastic member 414.

The valve body 412 includes a gas passage (not shown) and a pair of connecting holes (not shown) communicating with the gas passage. One connecting hole is connected to a gas hose (not shown) for connecting the connecting hole to an external gas supply source (not shown). The other connecting hole is connected to a gas hose (not shown) connected to the nozzle assembly 300.

A plug (not shown) is provided inside the valve body 412 to adjust open/close and an open degree of the valve 411. Since a structure capable of adjusting the open/close the open degree of the valve 411 using the plug is previously well-known, detailed descriptions thereof will be omitted.

The valve shaft 413 is rotatably installed in the valve body 412. A knob 420 and the plug are coupled to each of both ends of the valve shaft 413. Thus, when the user presses the knob 420, the plug is moved in a length direction of the valve shaft 413 to open the valve 411. Also, when the user pivots the valve shaft 413 in a clockwise direction or in a counterclockwise direction when viewed in FIG. 10, the plug adjusts a gas flow amount within the valve body 412.

In this embodiment, when the knob 410 is rotated in the clockwise direction, the open degree of the valve 411 increases. Also, when the knob 410 is rotated in the counterclockwise direction, the open degree of the valve 414 decreases.

The elastic member 414 provides an elastic force to the valve shaft 413 in a shield direction of the valve 411.

Thus, when the user removes a force pressing the knob 420 in the length direction of the valve shaft 413, the valve shaft 413 is moved by the elastic force of the elastic member 414 to allow the plug to shield the valve 411.

The first drive lever 415 and the second drive lever 416 are rotated by rotating the valve shaft 413. The first drive lever 415 turns on/off the on-off switch 417, and the second drive lever 418 turns on/off the ignition switch 418.

In this embodiment, when the valve shaft 413 is rotated in the clockwise direction, the on-off switch 417 turns on and the ignition switch 418 turns on in a state where an open degree of a flow of the valve body 412 is maximized by the plug.

The on-off switch 417 generates an electrical signal for turning on/off the light emitter 430. The on-off switch 417 includes a movable terminal 417*a* and a fixed terminal 417*b*. Thus, when the movable terminal 417*a* is spaced from the fixed terminal 417*b* to turns off the on-off switch 417, the light emitter 430 turns on. On the other hand, when the movable terminal 417*a* is in contact with the fixed terminal 417*b* by the first drive lever 415 to turn on the on-off switch 417, the light emitter 430 turns off.

The ignition switch 418 generates an electrical signal for generating a spark in the ignition plug 241. The ignition switch 418 includes a movable terminal 418*a* and a fixed terminal 418*b*.

Thus, when the movable terminal 418*a* is in contact with the fixed terminal 418*b* by the second drive lever 416 to turn on the ignition switch 418, a current is applied to the ignition plug 241 to generate the spark for burning the mixed gas supplied into the burner assembly 200.

Figure 11:
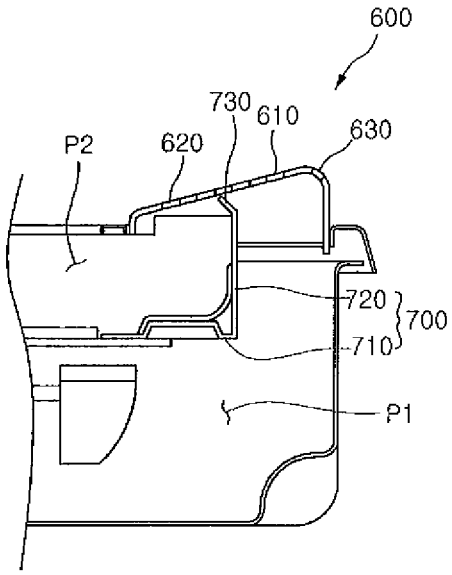
FIG. 11 is a partial side-sectional view of a cooking appliance according to an embodiment.

FIG. 11 is a partial side-sectional view of a cooking appliance according to an embodiment.

Referring to FIGS. 2 and 11, the flow guide unit 600 is disposed longitudinally in left and right directions.

The flow guide unit 600 includes a plurality of suction holes 610 for suctioning an outside air and a plurality of exhaust holes 620 for exhausting the combustion gas to the outside.

The suction hole 610 is disposed in a rear direction of the exhaust hole 620. That is, the suction hole 610 is disposed in an upper rear end of the flow guide unit 600, and the exhaust hole 620 is disposed in an upper front end of the flow guide unit 600.

The suction hole 610 and the exhaust hole 620 are substantially distinguished by the guide part 720 of the connection bracket 700.

The suction hole 610 communicates with the suction passage P1, and the exhaust hole 620 communicates with the exhaust passage P2.

An auxiliary suction hole 630 is defined in an upper end of a rear surface of the flow guide unit 600. Thus, the outside air is moved into the suction passage P1 through the suction hole 610 and the auxiliary suction hole 630.

Figure 12:
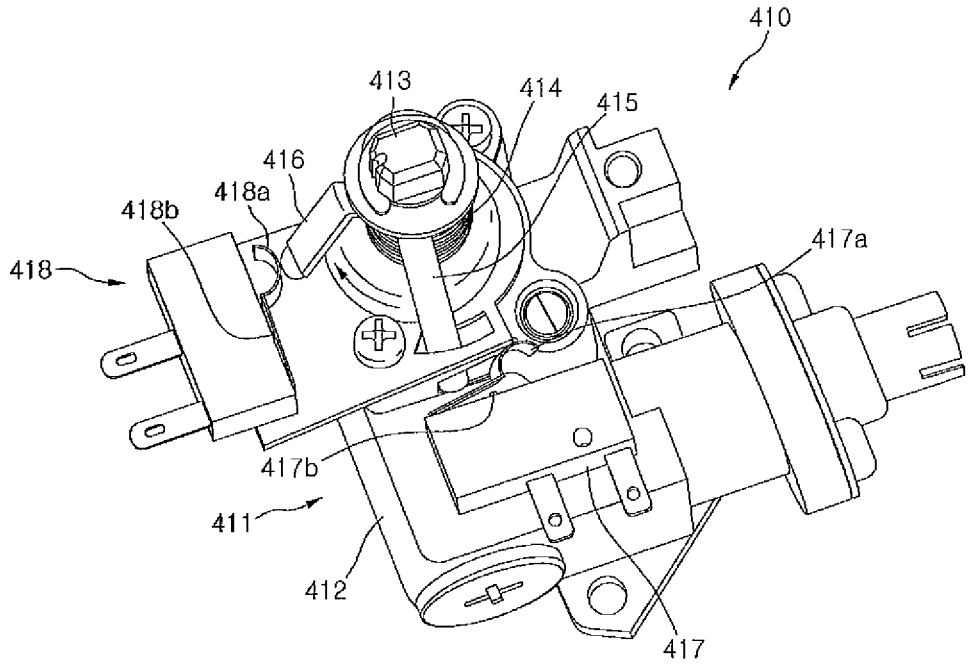
FIGS. 12 and 13 are perspective views illustrating an ON/OFF switching process of a valve assembly according to an embodiment.
Figure 13:
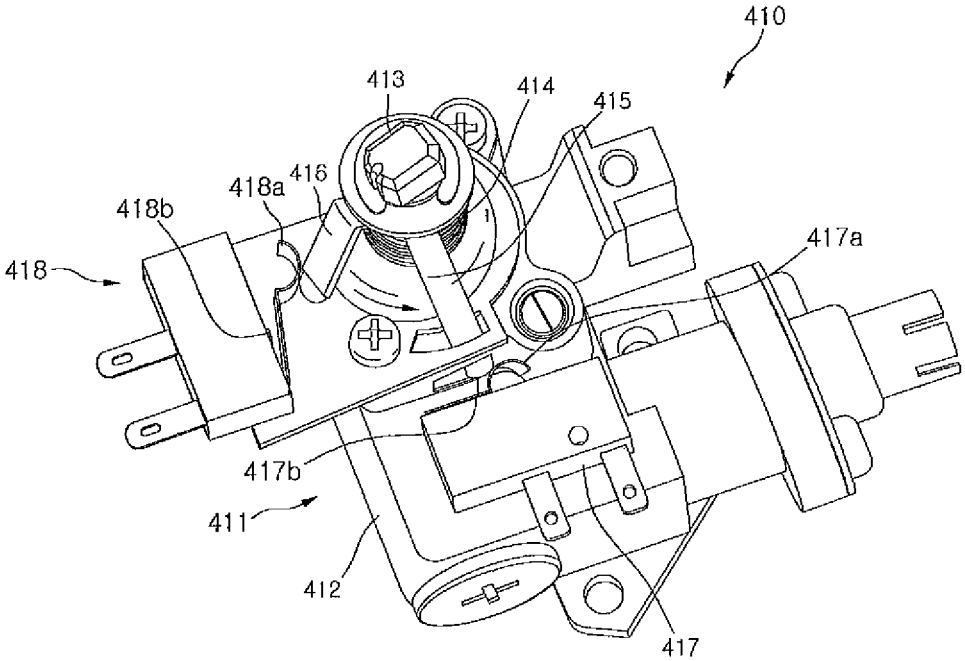
Figure 14:
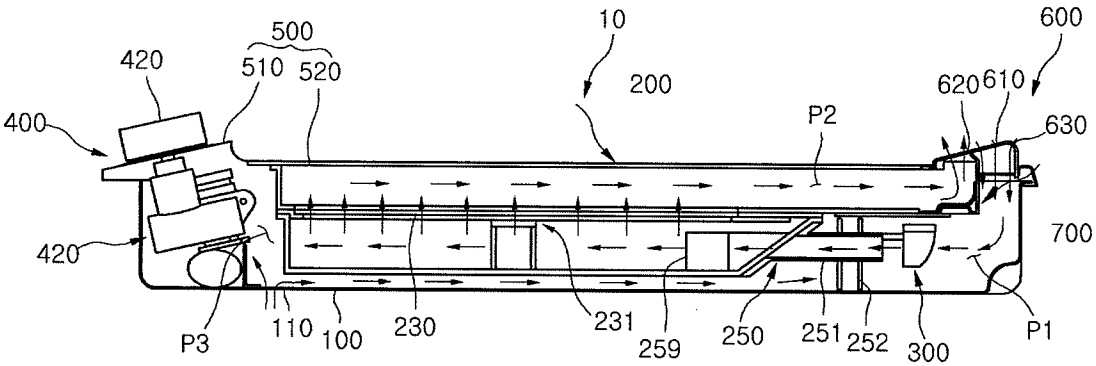
FIG. 14 is a vertical sectional view illustrating a flow of air inside a cooking appliance according to an embodiment.

FIGS. 12 and 13 are perspective views illustrating an ON/OFF switching process of a valve assembly according to an embodiment, and FIG. 14 is a vertical sectional view illustrating a flow of air inside a cooking appliance according to an embodiment.

Referring to FIGS. 1 to 14, the on-off switch 417 turns on by the first drive lever 415 in a state where the valve 411 of the valve assembly 410 is shielded. On the other hand, the ignition switch 418 turns off.

Thus, the gas is not supplied into the nozzle assembly 300, and the spark is not generated in the ignition plug 241, and simultaneously, the light emitter 430 maintains in an off state.

Referring to FIG. 12, when the user rotates the knob 410 in the clockwise direction to open the valve 411, the valve shaft 413 coupled to the knob 420 is also rotated in the clockwise direction. Thus, the valve 411 is opened to supply the gas into the nozzle assembly 300.

The gas supplied into the nozzle assembly 300 is mixed with the air within the suction passage P1 and supplied into the burner assembly 200 through the tube assembly 250 in a mixed gas state.

When the knob 420 is pivoted in the clockwise direction, the valve shaft 413 is also rotated in the clockwise direction. When the open degree of the valve 411 is maximized by rotating the valve shaft 413 in the clockwise direction, the ignition switch 418 turns on by the second drive lever 416.

Thus, the current is applied to the ignition plug 241 to generate the spark. As a result, the mixed gas supplied into the burner assembly 200 is ignited and burned.

When the open degree of the valve 411 is maximized, the on-off switch turns off. Thus, the light emitter turns on to allow the user to recognize that the mixed gas is being burned in the burner assembly 200.

When the mixed gas supplied into the burner assembly 200 is ignited due to the spark generated in the ignition plug 241, the knob 420 is rotated in the counterclockwise direction to adjust the open degree of the valve 411.

Referring to FIG. 14, the heat generated due to the combustion of the mixed gas in the combustion mat 230 is transmitted to the vessel seated on the top surface of the top plate 520 through the top plate 520. Thus, the vessel is heated to substantially heat the foods contained in the vessel.

The high-temperature combustion gas generated due to the combustion of the mixed gas in the combustion mat 230 flows into the exhaust passage P2. Then, the combustion gas is exhausted to the outside through the exhaust hold 620 of the flow guide unit 600 communicating with the exhaust passage P2. The guide part 720 of the connection bracket 700 guides the combustion gas exhausted through the exhaust hole 620 in a front direction. Thus, it prevents a rear wall, that is, a wall of a kitchen from being polluted by the combustion gas exhausted through the exhaust hole 620.

Since the combustion gas has a temperature and pressure higher than those of the outside air of the cooking appliance, the combustion gas is exhausted by a convection phenomenon into the outside (substantially, an atmospheric pressure) of the cooking appliance through the exhaust hole 620.

The gas injected from the injection nozzle 330 is speedily introduced into the tube assembly 250. At this time, since the gas passing through the mixing tube 251 of the tube assembly 250 has a high speed, a pressure of a space adjacent to an inlet of the tube assembly 250 is lower than the atmospheric pressure (an external pressure of the cooling appliance) due to a Bernoulli's theorem. Thus, the outside air of the cooling appliance 10 is suctioned into the suction passage P1 through the suction hole 610.

The upper barrier 270 transmits a portion of the heat of the combustion gas flowing through the exhaust passage P2 to the top plate 520. Thus, the foods can be warm in the warm zone of the top plate 520 disposed above the exhaust passage P2. The lower barrier 280 prevents the heat of the combustion gas flowing through the exhaust passage P2 from being transmitted to the tube assembly 250.

The air within the installation space 3 of the furniture 1 installed in the cabinet 100 is suctioned into the cabinet 100 through the cooling hole 110 of the cabinet 100 and flows into a cooling passage Pc.

The air flowing through the cooling passage Pc cools various components constituting the controller 400 and is exhausted through the cooling hole 110.

Although the cooking appliance is installed in the furniture in the above-described embodiments, the present disclosure is not limited thereto. For example, a self-standing type cooking appliance may be applied in the embodiments.

Also, in the above-described embodiments, a separate cooling pan for cooling electrical components including the controller installed inside the cabinet is not provided. However, for efficiently cooling the electrical components, the cooling pan may be provided.

According to the proposed embodiments, since mixing, combustion, ignition, and exhaust of the mixed gas are performed in a single burner assembly, the products can be simplified in structure.

Also, since the length of a mixing tube that mixes the gas and the air to generate the mixed gas can extend by a guide tube, the burner assembly can be reduced in size in a state where the mixing efficiency for the mixed gas can be maintained.

In addition, since the barrier is provided to block the transmission of the heat from the burner assembly to the nozzle assembly, the gas can be smoothly supplied from the nozzle assembly to the burner assembly.

Furthermore, since the pot cover functions to guide the air of the mixed gas to a combustion mat, the mixed gas can flow smoothly into the combustion mat.

Any reference in this specification to "one embodiment," an embodiment, "exemplary embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this invention. More particularly, various variations and modifications are possible in the component parts and/or arrangements of the subject combination arrangement within the scope of the invention, the drawings and the appended claims, In addition to variations and modifications in the component parts and/or arrangements, alternative uses will also be apparent to those skilled in the art.

What is claimed is:

1. A burner assembly comprising:

a burner pot receiving gas and air;

a combustion mat in which a mixed gas of the gas and the air supplied into the burner pot is burned;

a pot cover between the burner pot and the combustion mat to support the combustion mat;

a first burner frame configured to guide combustion gas generated due to the combustion of the mixed gas in the combustion mat;

a second burner frame connected to the first burner frame, and configured to guide the combustion gas from the first burner frame into a flow-guide;

a tube assembly configured to supply the gas and the air in a side direction of the burner pot, the tube assembly comprising a plurality of mixing tubes;

a contact part connected to the plurality of mixing tubes, the contact part being closely attached to the burner pot;

a nozzle assembly configured to supply the gas to the tube assembly; and a barrier between the second burner frame and the tube assembly, the barrier preventing heat of the second burner frame from being transmitted toward the tube assembly, wherein the combustion mat is fixed between the burner pot and the first burner frame.

2. The burner assembly according to claim 1, wherein the pot cover comprises a mixed gas guide hole configured to guide the mixed gas of the burner pot into the combustion mat.

3. The burner assembly according to claim 1, wherein the pot cover comprises a depressed mat seat part on which the combustion mat is seated.

4. The burner assembly according to claim 1, further comprising a gasket between the burner pot and the first burner frame, the gasket preventing the gas from leaking.

5. The burner assembly according to claim 1, wherein the burner pot has an inclined surface, and the contact part is inclined corresponding to the inclined surface, the contact part being closely attached to the inclined surface.

6. The burner assembly according to claim 1, wherein the burner pot comprises a guide tube increasing a flow path for mixing the gas and the air supplied from the tube assembly.

7. A burner assembly comprising:

a burner pot receiving mixed gas of gas and air;

a tube assembly configured to guide the gas and the air into the burner pot;

a nozzle assembly configured to supply the gas to the tube assembly;

a combustion mat in which the mixed gas supplied into the burner pot is burned;

a guide member configured to guide the mixed gas of the burner pot into the combustion mat;

a first burner frame configured to guide a flow of combustion gas generated due to the combustion of the mixed gas in the combustion mat;

a second burner frame extending from the first burner frame, the second burner frame guiding exhaust of the combustion gas; and a barrier between the second burner frame and the tube assembly, the barrier preventing heat of the second burner frame from being transmitted toward the tube assembly, wherein the combustion mat is fixed between the burner pot and the first burner frame, wherein the barrier is disposed above the tube assembly and the nozzle assembly, and disposed under the second burner frame, wherein the barrier is disposed between the second burner frame and the nozzle assembly, and wherein the barrier is disposed outside of the barrier pot and spaced apart from the burner pot.

8. The burner assembly according to claim 7, wherein the burner pot has an opened surface, and the guide member comprises a guide hole through which the mixed gas passes, the guide member shielding the opened surface of the burner pot.

9. The burner assembly according to claim 7, wherein the combustion mat is seated on the guide member.

10. The burner assembly according to claim 7, further comprising a guide tube inside the burner pot, the guide tube guiding the gas and the air supplied from the tube assembly into an inner space of the burner pot.

11. The burner assembly according to claim 7, wherein the tube assembly comprises:

a plurality of mixing tubes; and a contact part connected to the mixing tubes, the contact part being closely attached to the burner pot, wherein the barrier is connected to the plurality of mixing tubes.

12. A burner assembly comprising:

a burner pot receiving gas and air;

a combustion mat in which a mixture of the gas and the air supplied into the burner pot is burned;

a pot cover between the burner pot and the combustion mat to support the combustion mat;

a first burner frame configured to guide combustion gas generated due to combustion of the mixture in the combustion mat;

a second burner frame connected to the first burner frame, the second burner frame configured to guide the combustion gas from the first burner frame into a flow-guide;

a tube assembly configured to supply the gas and the air to the burner pot;

a nozzle assembly configured to supply the gas to the tube assembly;

a barrier between the second burner frame and the tube assembly, the barrier preventing heat of the second burner frame from being transmitted toward the tube assembly; and an ignition part that generates a spark for the combustion of the mixture, the ignition part mounted to the first burner frame, wherein the ignition part includes a plug assembly, wherein the plug assembly includes an ignition plug, a plug target, and a plug holder on which the ignition plug and the plug target are installed, wherein the plug holder is fixed to the first burner frame, and wherein the ignition plug and the plug target pass through the first burner frame and are disposed above the combustion mat in a state where the ignition plug and the plug target are installed on the plug holder.

* * * * *